United States Patent [19]

Becher

[11] 4,000,750

[45] Jan. 4, 1977

[54] LARGE SHELTER UMBRELLA

[75] Inventor: Klaus Becher, Gummersbach, Germany

[73] Assignee: Carl Becher OHG Planen- und Zelte-Fabrik, Gummersbach, Germany

[22] Filed: Aug. 28, 1975

[21] Appl. No.: 608,512

[30] Foreign Application Priority Data

Aug. 31, 1974 Germany ..... 2441816

[52] U.S. Cl. ..... 135/16; 104/137; 135/20 M

[51] Int. Cl.[2] ..... A45B 3/00; A45B 17/00

[58] Field of Search ..... 135/1 A, 4 A, 5 A, 7, 135/16; 52/116; 173/28; 296/78 R; 248/2, 16, 354 H; 104/53, 137; 272/29; 105/238 R; 182/68; 254/139.1

[56] References Cited

UNITED STATES PATENTS

| | | | |
|---|---|---|---|
| 280,802 | 7/1883 | Dark | 104/137 |
| 1,035,570 | 8/1912 | Gary et al. | 182/68 |
| 2,241,275 | 5/1941 | Shinn et al. | 52/116 |
| 2,258,918 | 10/1941 | Wagner et al. | 52/116 |
| 2,964,122 | 12/1960 | Funk et al. | 182/68 |
| 3,189,134 | 6/1965 | Womack et al. | 254/139.1 |
| 3,315,422 | 4/1967 | McIntyre | 254/139.1 |
| 3,344,568 | 10/1967 | Erickson et al. | 52/116 |

*Primary Examiner*—Werner H. Schroeder
*Assistant Examiner*—Conrad L. Berman
*Attorney, Agent, or Firm*—Diller, Brown, Ramik & Wight

[57] ABSTRACT

This disclosure relates to a large shelter umbrella including a base having a supporting post the top of which is an umbrella, means mounting the supporting post at an end portion thereof for pivotal movement about a generally horizontal axis, the end portion having a free terminal end, means connected to the free terminal end for imparting a force thereto to pivot the supporting post about a horizontal axis, and lifting element means at a side of the horizontal axis opposite the terminal end connected between the base and the supporting post for imparting a force to the supporting post to pivot the latter about the horizontal axis.

8 Claims, 4 Drawing Figures

LARGE SHELTER UMBRELLA

The present invention is directed to standing umbrellas, more particularly large shelter umbrellas, and includes as a primary object means for easily tilting the umbrella between generally vertical and horizontal positions and readily transporting the same.

Large shelter umbrellas normally include a support tube, cover spokes, struts which support the cover spokes, and the spokes and struts are generally collapsible or foldable against the support tube. Such large shelter umbrellas are used as temporary or permanent umbrellas because of their size and height and also because of the area spanned or covered thereby which can be up to perhaps 200 to 300 meters square. Thus in the usual case such large shelter umbrellas remain in situ and are anchored in an appropriate foundation. Typical of such applications for large shelter umbrellas are beer gardens, terrace restaurants and the like, but applications are also found in industry where a particular environment need be covered only occasionally.

It is obviously also highly desirable to have such large shelter umbrellas which are readily transportable when the locations which are to be covered require changing. An example of such use would be the case of temporary exhibitions and fairs, such as agricultural exhibitions, which change their locations comparatively often in rural or farming districts. The same may be said of industrial exhibitions at locations which are not permanent, and therefore the desirability to move an umbrella of a large size from place to place is highly desirable.

Such large shelter umbrellas have the advantage that a comparatively large area is covered by a single vertical post or column, thus enhancing the use to which the covered space can be put, and the opening and closing of the associated covers involves comparatively little trouble. Also, such large shelter umbrellas can provide an emergency quick-covering for almost any area.

In keeping with the foregoing, it is therefore another object of this invention to provide a large shelter umbrella of the standing type which may be moved easily and quickly yet the rigidity of the large shelter umbrella is guaranteed despite its mobility. In order to achieve this latter object the invention is characterized in that a supporting tube or post is pivotally mounted at its lower end portion between two pedestals about a generally horizontal pivot shaft or axis with the lower end portion projecting axially beyond the pivot shaft to which is connected a hoist cable while a lifting element is pivotally connected to the support tube approximately medially of its length.

In keeping with the construction immediately heretofore described, a relatively heavy and tall large shelter umbrella is stable in its upright opened condition yet can be readily collapsed and tilted for transport to another location.

Due to the manner in which the support tube is pivoted between two bearing pedestals about a transverse or horizontal pivot, the plane of tilting of the umbrella is predetermined and assured. Preferably, the support tube is constructed as a double-arm lever, one of its arms being operated by the lifting element which may, for example, be a conventional piston and cylinder actuated by a pressurized hydraulic medium, while a tensile force operative through a chain or cable is connected to the terminal lowest end of the support tube for assisting in pivotal movement of the latter both for elevating or lowering purposes. Due to the latter two elements (lifting element and tensile force applying means) no further auxiliary lifting or lowering means are required and outside manual labor is unnecessary except for a single person or a maximum of two persons for operating the lifting element and the tensile force applying means. Furthermore, both the lifting element and the tensile force applying means guarantee a high degree of safety and rigidity of the umbrella when in its upright and opened position to assure collapse under adverse climatic conditions, such as storms when wind velocities are relatively high.

In accordance with another object of this invention the pedestals, the lifting element and the tensile force applying means (chain or cable and winch) are arranged on a mobile platform. In this manner a shifting of the base for the tilting operation is produced by simple means so that when the closed umbrella is lowered or tilted over only a portion of the distance of the diameter of the cover surface with the umbrella erected is required for the tilting operation. This is particularly important when several umbrellas are arranged with their covers or covering surfaces side-by-side, and this is further particularly advantageous when the cover or covering surfaces are square or rectangular in outline.

In order to increase the efficiency of the tensile force applying means a guide roller or pulley is provided for the cable or chain at a point between an associated cable winch and a point at which the cable is attached to the lowermost terminal end of the support tube. Preferably the latter guide pulley is contiguous and beneath the axis of the umbrella support tube when the latter is in its vertical upright position. This achieves a favorable operative angle of the cable or chain acting upon the support tube of the umbrella during the entire range of its elevation or lowering. Furthermore, this construction also allows the winch for the cable to be carried directly by the mobile platform.

The platform is advantageously capable of moving on rails and is secured relative to the rails against being lifted therefrom as, for example, by driver elements which engage behind the rails and which are fixed on the platform. Thus, when it is desired to change the position of the collapsed large shelter umbrella the rails and the platform which is moved along the rails can be supported upon a transporting wagon or truck and preferably upon a chassis of the latter which can be itself elevated or lowered.

In further accordance with this invention, a supporting brace is also disposed diametrically opposite to the lifting element between the platform and the supporting post when the latter is in its vertical position. In this way, the lifting element itself serves as a rigidifying supporting strut in the upright position of the support post. However, in the tilted position the supporting strut or stay is connected to an uppermost end of the umbrella to provide stability when the latter is being transported in its collapsed condition.

With the above and other objects in view that will hereinafter appear, the nature of the invention will be more clearly understood by reference to the following detailed description, the appended claimed subject matter, and the several views illustrated in the accompanying drawing.

IN THE DRAWINGS

Figure 1:
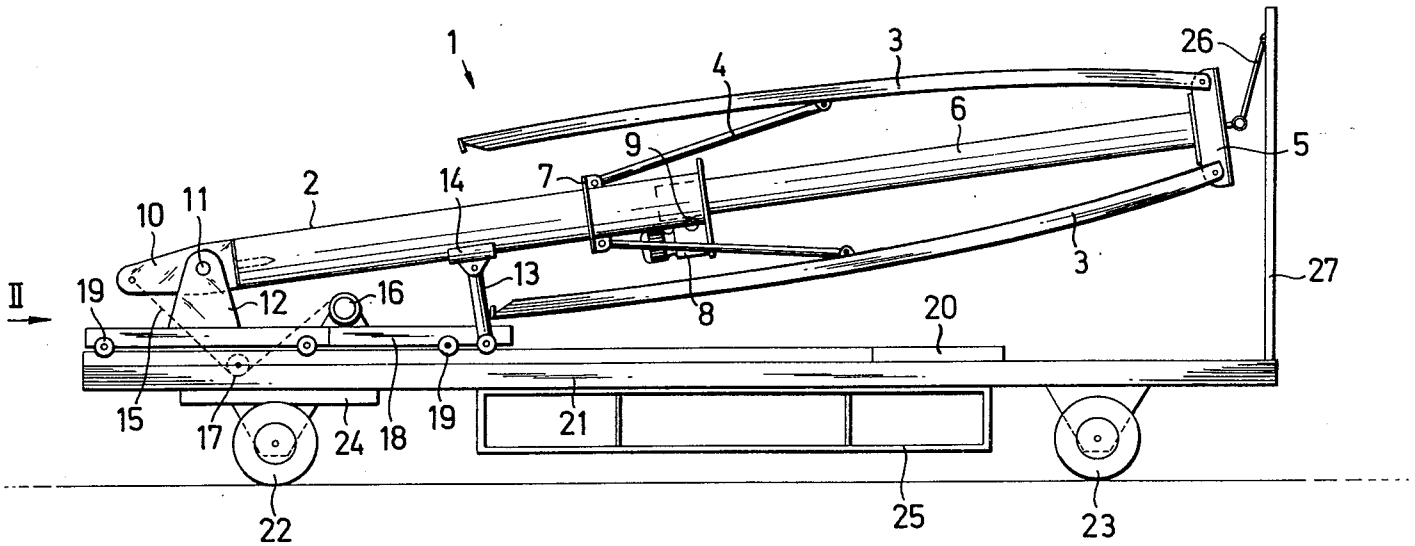
FIG. 1 is a diagrammatic side elevational view and illustrates a novel large shelter umbrella in its collapsed and lowered condition carried by a base with a cable being connected between a free terminal lower end of a supporting post and a winch as well as a hydraulic motor connected between a medial portion of a tubular support and the base.

A novel large shelter standing umbrella constructed in accordance with this invention is generally designated by the reference numeral 1 and includes a support tube or supporting post 2 to which struts 4 are pivotally connected at one end at 7 and at an opposite end to a plurality of cover spokes 3. The cover spokes 3 are in turn pivoted or hinged to a head piece 5 of a slide member or lifting tube 6 which is in internal telescopic relationship to the supporting post 2. In order to lift or lower the tube 6 relative to the supporting post 2, there is provided drive means 8 in the form of a geared breaking motor which rotates a pinion 9 in mesh with a rack (unnumbered) running longitudinally along the post 6. Thus, depending upon the rotation of the pinion 9 the post 6 will move into or out of the tubular supporting post 2.

Figure 4:
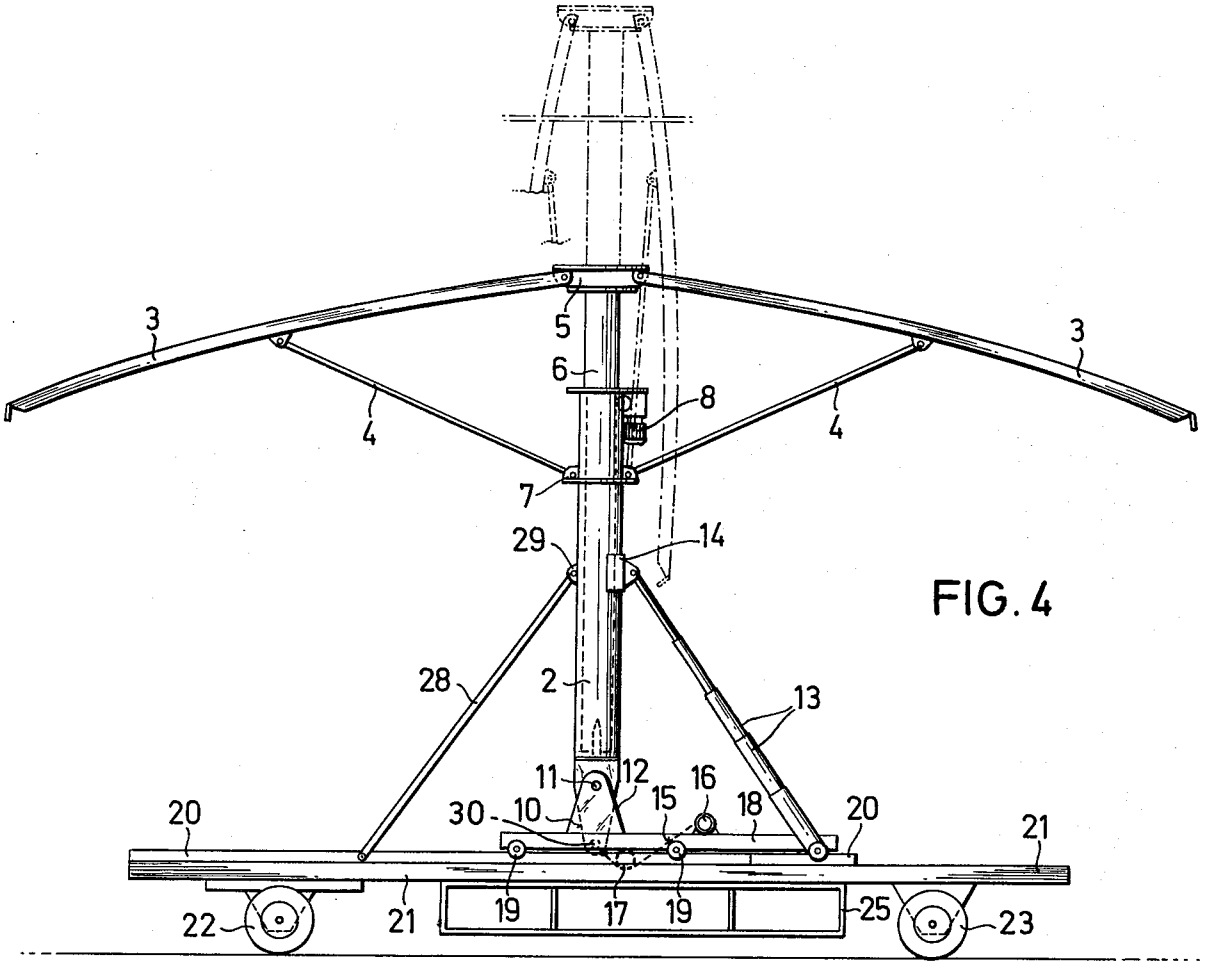
FIG. 4 is a view similar to FIGS. 1 and 3, and illustrates in solid and phantom outline, respectively, the opened and closed positions of spokes of the umbrella which support a cover (not shown).

The umbrella is provided with an umbrella cover (not shown) which depending upon the length of the cover spokes 3 may be of a circular, square or rectangular outline. Furthermore, as is best shown in FIG. 4, the umbrella has a smaller height in the opened position (solid outline in FIG. 4) than in the closed position (phantom outline in FIG. 4). The withdrawal or outward movement of the slide member or lifting tube 6 from within the supporting post or tube 2 in order to close the umbrella has the advantage that the opened umbrella is in the lowered position (solid outline in FIG. 4) and thus the umbrella cover in the closing position remains with its end points above a horizontal plane through the end points of the spokes 3.

The supporting post or support tube 2 is provided with a lower terminal end portion or foot 10 which is mounted to pivot about a transverse, generally horizontal, pivot shaft or axis 11 between two upstanding pedestals 12 such that the transverse pivot shaft 11 is spaced from the absolute free terminal end (unnumbered) of the foot or terminal end portion 10. Means generally designated by the reference numeral 13 is pivotally connected by a bracket 14 to the supporting post 2 and at its opposite end is pivotally connected to a platform 18. The lifting means 13 is preferably a hydraulically operated piston-cylinder mechanism.

Figure 2:
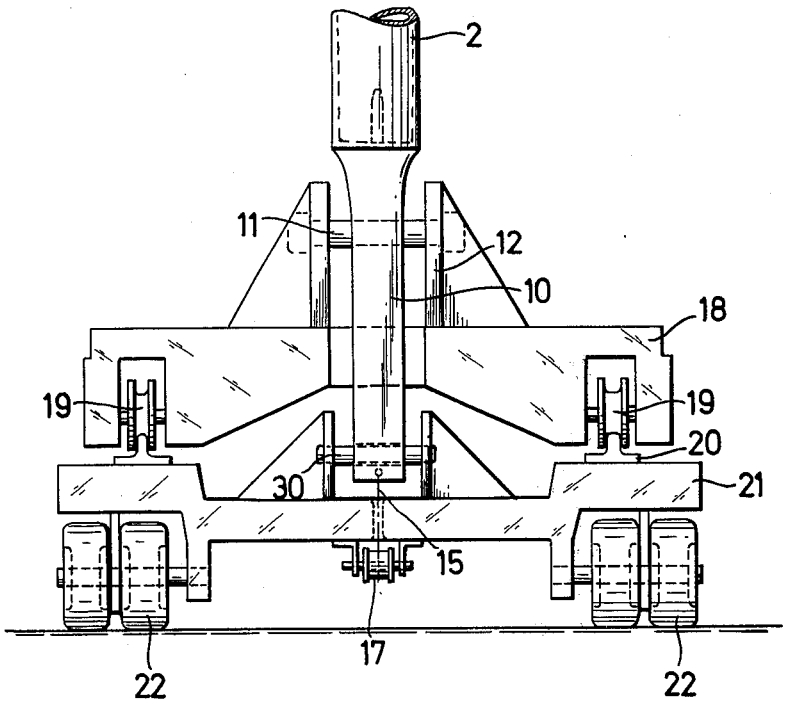
FIG. 2 is a diagrammatic enlarged end view looking along line II of FIG. 1, and illustrates details of the pivoting mounting of the supporting post to a base or platform which through wheels rides on rails of an underlying wheeled support.

Also connected to the most terminal end of the end portion or foot 10, is a cable or chain 15, which is entrained about a pulley 17 and coupled to a winch 16. The winch 16 can be operated by hand by the use of a conventional crank or can be motor driven. The guide pulley 17 lies beneath the platform 18 generally beneath and contiguous to the pivot shaft 11 so that a suitably large angle is available for the pivoting of the supporting post 2. Thus the pedestals 12, the winch 16 and the lifting element 13 are all carried by the platform 18 which in turn includes wheels 19 (FIG. 2) traveling atop rails or tracks 20 of another platform or base 21 which at its underside carries the pulley 17 and includes wheels 22. It is desirable for the platform 18 to be incapable of inadvertent upper removal from the platform 21 by disengagement between the respective wheels 19 and rails 20, and this can, for example, be effected by means of driver plates (not shown) or the like which engage beneath and/or into longitudinal grooves or the like (not shown) in the rails 20. The entire assembly can be bodily moved by movement of the platform or base 21 through motion of the wheels 22, 23 with the wheels 22, 23 being mounted for pivotal motion, if desired, about a vertical axis for steering purposes. Containers 25 are also carried by the base or platform 21 to accommodate weights for stabilizing the umbrella 1, particularly in its set-up condition (solid outline in FIG. 4).

In the collapsed or tilted position (FIG. 1) of the umbrella 1 the uppermost terminal end portion (unnumbered) of the sliding member 6 is preferably secured to an upstanding brace 27 carried by the platform 21 through a pivotally connected rod or bracket 26. This obviously stabilizes the umbrella 1 during transport.

Likewise, in the vertical position of the supporting post 2 (FIG. 4) a stabilizing rod 28 may be provided between the platform 20 and a pivot 29 of the supporting post 2. The latter support or strut 28 is diametrically opposite to the extended element 13 in order that both of the latter rigidly support the supporting post 2 in the vertical position thereof.

Figure 3:
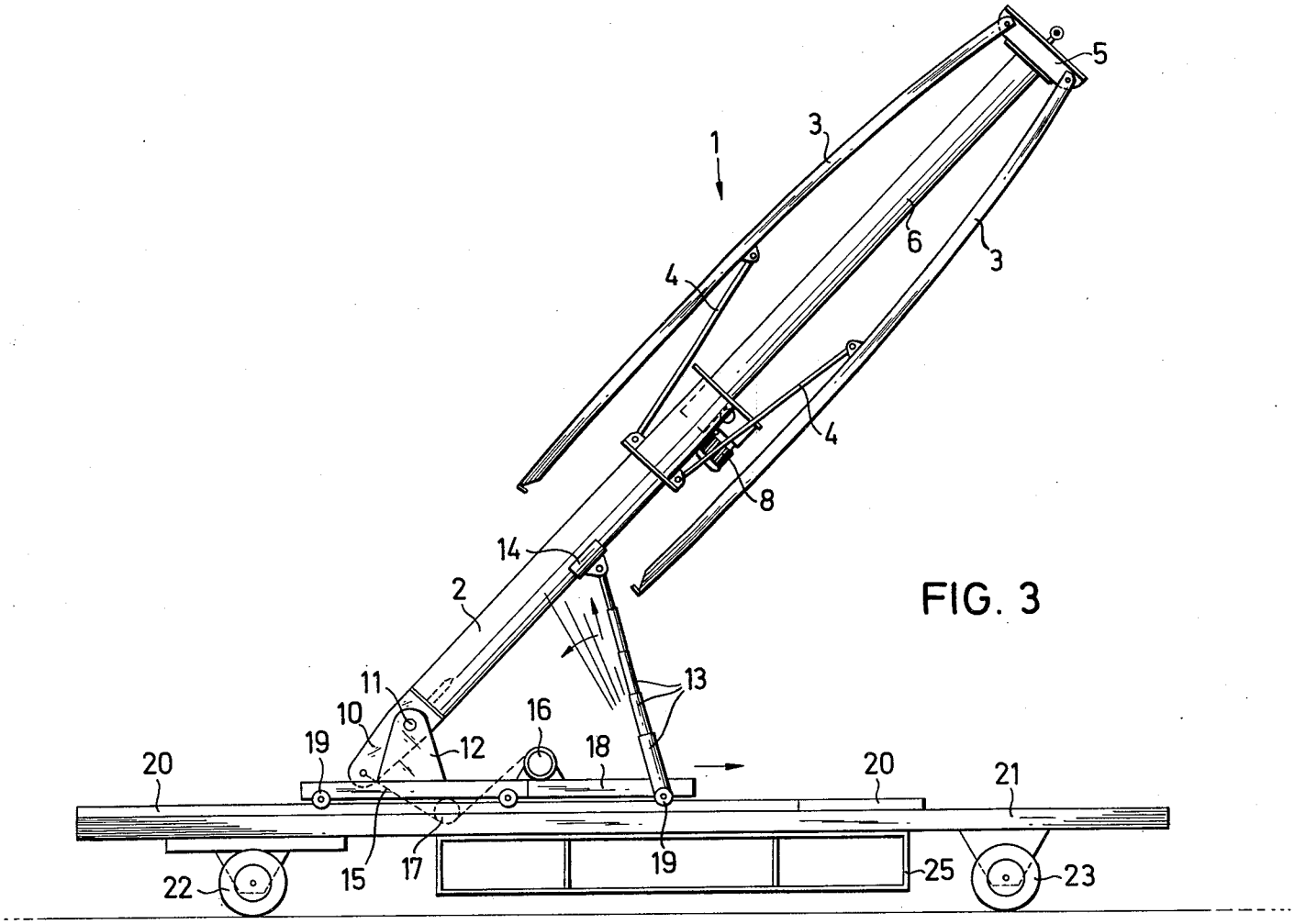
FIG. 3 is a view similar to FIG. 1, and illustrates the manner in which the umbrella may be moved from its generally horizontal to a vertical position.

In order to move the umbrella from its generally horizontal position (FIG. 1) to its vertical position (FIG. 4) the lifting elements 13 and 15, 16 are operated simultaneously. The latter lifting or force applying elements simultaneously pivot the supporting post 2 about the pivot shaft 11 in the manner best illustrated in FIG. 3. At the same time the platform 18 can be moved along the rails 20 toward the middle of the platform 21 so as always to obtain the most favorable type of loading or force application to the supporting post 2. Once the platform 20 is moved generally to the middle of the platform 21 the platforms 20, 21 can be locked to each other in any conventional fashion as, for example, by locking the wheels 19 to the rails 20. Once the supporting post 2 is in its vertical position the strut 28 can be positioned as shown in FIG. 4 and if desired the supporting post 2 can additionally be locked at its terminal end or foot 10 by means of an insertion bolt 30 (FIG. 2) passing through an aperture of the foot 10 and upstanding brackets (unnumbered) carried by the platform 21.

While preferred forms and arrangement of parts have been shown in illustrating the invention, it is to be clearly understood that various changes in details and arrangement of parts may be made without departing from the scope and spirit of this disclosure.

I claim:

1. A large shelter umbrella comprising a base, an umbrella including a supporting post having first and second opposite terminal end portions, first pivot means mounting said supporting post adjacent a terminal end of said first terminal end portion for pivotal movement about a generally horizontal axis for pivotal movement of said supporting post between generally horizontal and vertical positions, cable means connected to said first terminal end portion, means for forcefully drawing said cable means to pivot said support post about said horizontal axis from said horizontal position to said vertical position, lifting element means connected between said base and said supporting post for imparting a force to said supporting post to pivot the latter about said horizontal axis from said horizontal position to said vertical position, said lifting element means being a telescopic mechanism having at least a pair of relatively telescopic elements, second pivot means for pivotally connecting a first of said telescopic elements to said base about a generally horizontal axis, third pivot means directly pivotally connecting a second of said telescopic elements to said supporting post, and said third pivot means is connected to said supporting post remote from said first pivot means and generally centered between said first and second terminal end portions, said base is a platform mounted for sliding movement upon a carriage, said first pivot means is carried by said platform, said drawing means is carried by said platform, and means carried by said carriage about which said cable means is at least partially entrained.

2. The large shelter umbrella as defined in claim 1 including rails and wheels between said platform and carriage for effecting relative reciprocal movement therebetween in directions normal to said firs pivot means.

3. The large shelter umbrella as defined in claim 1 wherein said cable entraining means is a pulley having an axis of rotation generally parallel to said first pivot means.

4. The large shelter umbrella as defined in claim 3 including rails and wheels between said platform and carriage for effecting relative reciprocal movement therebetween in directions normal to said first pivot means.

5. A large shelter umbrella comprising a base, an umbrella including a supporting post having first and second opposite terminal end portions, first pivot means mounting said supporting post adjacent a terminal end of said first terminal end portion for pivotal movement about a generally horizontal axis for pivotal movement of said supporting post between generally horizontal and vertical positions, cable means connected to said first terminal end portions, means for forcefully drawing said cable means to pivot said support post about said horizontal axis from said horizontal position to said vertical position, said base being a platform mounted for sliding movement upon a carriage, said first pivot means is carried by said platform, said drawing means is carried by said platform, and means carried by said carriage about which said cable means is at least partially entrained.

6. The large shelter umbrella as defined in claim 5 including rails and wheels between said platform and carriage for effecting relative reciprocal movement therebetween in directions normal to said first pivot means.

7. The large shelter umbrella as defined in claim 5 wherein said cable entraining means is a pulley having an axis of rotation generally parallel to said first pivot means.

8. The large shelter umbrella as defined in claim 7 including rails and wheels between said platform and carriage for effecting relative reciprocal movement therebetween in directions normal to said first pivot means.

* * * * *